US007313893B2

(12) United States Patent
Voegele, Jr.

(10) Patent No.: US 7,313,893 B2
(45) Date of Patent: Jan. 1, 2008

(54) PANEL CLIP ASSEMBLY FOR USE WITH ROOF OR WALL PANELS

(75) Inventor: William P. Voegele, Jr., Pittsburgh, PA (US)

(73) Assignee: Extech/Exterior Technologies, Inc., Pittsburgh, PA (US)

( * ) Notice: Subject to any disclaimer, the term of this patent is extended or adjusted under 35 U.S.C. 154(b) by 491 days.

(21) Appl. No.: 10/706,557

(22) Filed: Nov. 13, 2003

(65) Prior Publication Data

US 2005/0102943 A1 May 19, 2005

(51) Int. Cl.
*E04D 1/36* (2006.01)
*E04B 2/00* (2006.01)

(52) U.S. Cl. ..... 52/461; 52/582.1

(58) Field of Classification Search ..... 52/395, 52/520, 551, 549, 478, 466, 544, 537, 764, 52/772, 461, 469, 582.1, 588.1, 20, 547; 403/72, 80; 43/72, 80
See application file for complete search history.

(56) References Cited

U.S. PATENT DOCUMENTS

| | | | | |
|---|---|---|---|---|
| 453,470 | A | 6/1891 | Geiger et al. | |
| 616,617 | A | 12/1898 | Hulse | |
| 981,813 | A | 1/1911 | Storch | |
| 1,119,829 | A | 12/1914 | Jeter | |
| 1,379,359 | A | 5/1921 | Partzschefeld, Jr. | |
| 1,773,299 | A | 8/1930 | Braeger | |
| 1,882,105 | A | 10/1932 | Wender | |
| 2,073,278 | A | 3/1937 | Hohl | |
| 2,653,686 | A | 9/1953 | Routt | |
| 2,667,242 | A * | 1/1954 | Kullmer | 52/282.4 |
| 2,725,832 | A | 12/1955 | Huntington | |
| 3,063,201 | A | 11/1962 | Rylander | |
| 3,082,849 | A * | 3/1963 | Keller | 52/475.1 |
| 3,483,665 | A * | 12/1969 | Miller | 52/461 |
| 3,574,449 | A * | 4/1971 | Rosenberg | 359/896 |
| 3,605,574 | A * | 9/1971 | Hall | 404/64 |
| 3,916,589 | A | 11/1975 | Richter | |
| 3,998,019 | A * | 12/1976 | Reinwall, Jr. | 52/478 |
| 4,001,995 | A | 1/1977 | Cotter | |
| 4,102,105 | A * | 7/1978 | Taylor et al. | 52/520 |
| 4,135,342 | A | 1/1979 | Cotter | |
| 4,139,974 | A * | 2/1979 | Fox | 52/404.2 |
| 4,157,639 | A | 6/1979 | Saunders | |
| 4,184,299 | A | 1/1980 | East | |

(Continued)

FOREIGN PATENT DOCUMENTS

GB 2 167 101 A 5/1986

*Primary Examiner*—Richard E. Chilcot, Jr.
*Assistant Examiner*—Ryan D Kwiecinski
(74) *Attorney, Agent, or Firm*—McKay & Associates, P.C.

(57) ABSTRACT

A clip assembly secures standing seam skylight or roofing panels to substrates and allows for a full range of movements by the panels while eliminating or reducing frictional noises. The clip assembly may also be used with wall panel systems. The clip assembly includes a first clip member and a second clip member each having an upright member and an upper flange member and a lower flange member extending therefrom. The assembly further includes a gap formed between the upright member of the first clip member and the upright member of the second clip member. In one aspect the clip assembly includes a base which allows the assembly to slide.

23 Claims, 5 Drawing Sheets

U.S. PATENT DOCUMENTS 4,189,881 A 2/1980 Hawley
4,193,247 A 3/1980 Heckelsberg
4,361,998 A 12/1982 Ellison et al.
4,400,922 A 8/1983 Boyer
4,402,168 A * 9/1983 Maier, Jr. ..... 52/478
4,435,937 A * 3/1984 Stone ..... 52/520
4,463,534 A 8/1984 Crigler
4,495,743 A 1/1985 Ellison et al.
4,514,952 A * 5/1985 Johansson ..... 52/713
4,543,760 A 10/1985 Barker et al.
4,570,404 A * 2/1986 Knudson ..... 52/520
4,573,300 A 3/1986 Bezner
4,575,983 A * 3/1986 Lott et al. ..... 52/544
4,649,684 A * 3/1987 Petree et al. ..... 52/395
4,796,403 A 1/1989 Fulton et al.
4,808,039 A * 2/1989 Fischer ..... 405/281
4,999,951 A 3/1991 Keys et al.
5,001,881 A * 3/1991 Boyd ..... 52/545
5,001,882 A 3/1991 Watkins et al.
5,181,360 A 1/1993 Shingler
5,187,911 A 2/1993 Cotter
5,222,341 A 6/1993 Watkins et al.
5,363,624 A 11/1994 Cotter
5,514,952 A 5/1996 Parkinson
5,596,858 A * 1/1997 Jordan ..... 52/460
5,606,838 A 3/1997 Hughes et al.
5,692,345 A 12/1997 Mogaki et al.
5,704,509 A * 1/1998 Rosenkrantz ..... 220/216
5,737,892 A 4/1998 Greenberg
5,927,027 A * 7/1999 Richardson ..... 52/200
5,974,752 A 11/1999 Watson
5,998,747 A 12/1999 Kelso et al.
6,148,565 A 11/2000 Lancaster
6,164,024 A 12/2000 Konstantin
6,289,646 B1 9/2001 Watanabe
6,354,045 B1 * 3/2002 Boone et al. ..... 52/95
6,588,165 B1 7/2003 Wright
6,845,592 B2 * 1/2005 Voegele ..... 52/466
2002/0124514 A1 9/2002 Higgins

* cited by examiner

PANEL CLIP ASSEMBLY FOR USE WITH ROOF OR WALL PANELS

CROSS REFERENCE TO RELATED APPLICATIONS

This application is related to U.S. Provisional Application Ser. No. 60/424,706 filed Nov. 8, 2002.

BACKGROUND OF THE INVENTION

1. Field of the Invention

The present invention generally relates to a panel clip assembly and more particularly, to a panel clip assembly for use with skylight, roof or wall panels having improved strength, improved noise reduction and improved allowance for longitudinal and transverse panel movement in response to thermal expansion and contraction of the panels.

2. Description of the Prior Art

It is well known to secure standing seam roof and wall panels, including translucent panels, to purlin or girt substrates using hidden clips and related clip assemblies. Examples of various of these clip assemblies are shown in U.S. Pat. Nos. 4,184,299, 4,193,247, 4,361,998, 4,495,743, 4,543,760, 4,575,983, 5,001,882, 5,181,360, 5,222,341, 5,363,624, 5,606,838 and 6,164,024. As noted in this prior art, a continuing problem has existed concerning the impact of thermal forces (expansion and contraction) on panels supported and joined together by clip assemblies. By way of example, if clip assemblies are too rigid, damage may occur to the panels or clip assemblies during thermal expansion or contraction. In addition, undesirable noises and wear are caused by frictional panel movement resulting from thermal and other forces, i.e. panels rubbing against the clip assembly, against the fasteners that hold the clip assembly, and against the substrates. Our design addresses these problems.

Also, in response to these concerns, some prior clip assemblies have been designed with two interlocking but moveable pieces. More specifically, clip assemblies have been designed with a lower base member that is fixed to a substrate and an upper clip member which is attached to the base member in such a manner that the upper clip member can slide parallel to the seam created by adjoining panel members. See, e.g., U.S. Pat. No. 4,575,983. This sliding movement helps relieve expansion and contraction forces that run parallel to the panel seam.

Existing clip assemblies continue to experience problems from thermal forces, however. In particular, existing clip assemblies are too rigid in respect to, and do not adequately address, thermal forces that are applied perpendicular to panel seams (and perpendicular to the sliding movement allowed for in the clip assemblies described above). Thus, wear and damage problems from such forces continue to exist. In addition, unwanted frictional noises have not been satisfactorily eliminated or reduced.

Further, there exists a need for an improved clip assembly which satisfactorily allows for and addresses a range of panel movements and which raises up and supports the panels at their undersides sufficient to allow the panels to avoid rubbing contact with the substrate, on which the panel clips are mounted. No existing clip assembly addresses the need for an assembly that includes these features and that allows for and addresses various ranges of movement experienced by panels and that also eliminates or reduces corresponding frictional noises and wear.

SUMMARY OF THE INVENTION

It is therefore an object of the present invention to address the above shortcomings of the prior art. In particular, it is an object of the present invention to allow movement of the panels. It is a further object of the present invention to allow for panel movements in the planes of the panels that are both longitudinal and transverse to the seam formed by adjoining panels and typically arising from thermal expansion or contraction of the panels. It is also an object of the present invention to reduce wear and noise resulting from frictional movement of roof panels against a substrate or clip assembly.

In one aspect of the present invention, the clip assembly secures standing seam skylight or roofing panels to a substrate and allows for longitudinal movement by the panels, while eliminating or reducing frictional noises and wear. The clip assembly may also be used with wall panel systems.

In another aspect of the present invention, a clip assembly for use with a panel system is provided. The clip assembly includes a first clip member having an upright member and an upper flange member and a lower flange member extending therefrom. The assembly further includes a second clip member having an upright member and an upper flange member and a lower flange member extending therefrom. The lower flange member of the second clip member extends in a substantially same direction as the lower flange member of the first clip member. A gap is formed between the upright member of the first clip member and the upright member of the second clip member and the first clip member and the second clip member constrain adjoining panels of the panel system against forces.

In yet another aspect of the present invention, a slideable clip assembly for use with a panel system includes a first and second clip member, each having an upright member having a first and a second end. An upper flange member extends from the upper end and a lower flange member extends from the lower end of each clip member. A base member is also provided which has a means for communicating with at least the lower flange member of the second clip member such that the first clip member and the second clip member slide between a first position and a second position while the base member remains stationary.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTIONS OF PREFERRED EMBODIMENTS OF THE INVENTION

Figure 1:
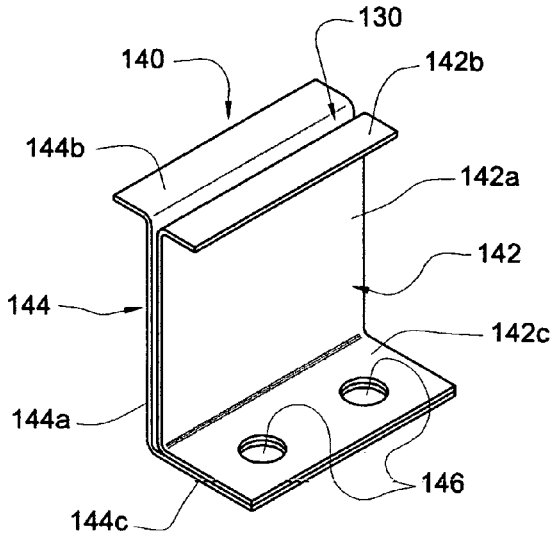
FIG. 1 is an isometric view of a preferred embodiment of the clip assembly of the present invention.

FIG. 1 in an isometric view of a preferred embodiment of the clip assembly of the present invention. In this embodiment, the clip assembly is generally designated by reference numeral 140. The clip assembly 140 includes a first clip member 142 and a second clip member 144. The first clip member is substantially a "C" shaped clip member having an upright body portion 142*a* and respective upper and lower extending horizontal flanges 142*b* and 142*c*. The lower horizontal flange 142*c* includes openings or holes 146 designed to accommodate a fastening member. The second clip member 144 is substantially an "S" shaped clip member having an upright body portion 144*a* and upper and lower extending horizontal flanges 144*b* and 144*c*, where the upper and lower extending horizontal flanges 144*b* and 144*c* extend in opposite directions. The lower horizontal extending flange 144*c* further includes holes 146 corresponding to and aligned with the holes 146 of the horizontal extending flange 142*c*.

Figure 2:
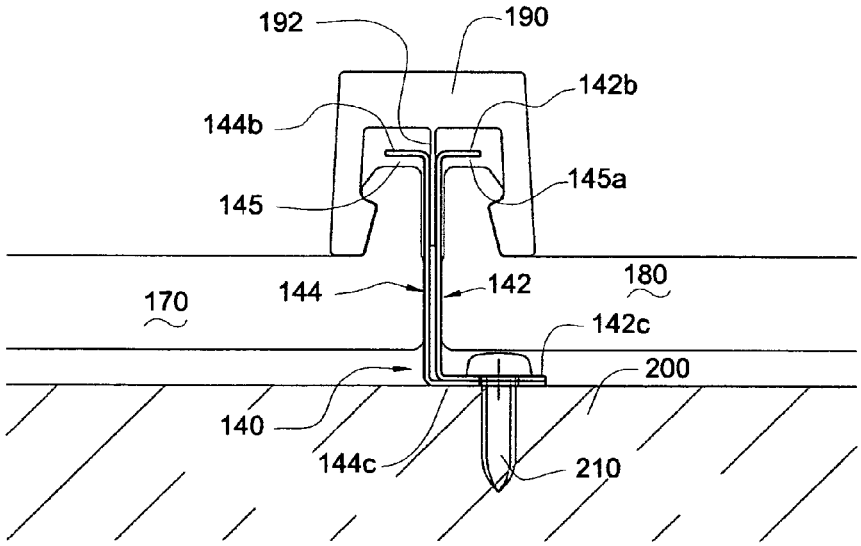
FIG. 2 is a sectional view of the clip assembly of the present invention used with a standing seam roof or skylight assembly.

In the assembled configuration of FIG. 2, the first and second clip members 142 and 144 are mated together. In this configuration, the upper horizontal flange 142*b* and 144*b* extend in opposing directions. Additionally, the lower horizontal flange 144*c* extends in a same direction and is positioned beneath the lower horizontal flange 142*c*. In this manner, the holes 146 of each clip member 142 and 144 are aligned, thus allowing a fastening member to pass therethrough. A gap 130 is provided between the first and second clip member 142 and 144 and is best observed in FIG. 1 between the respective upright body portions 142*a* and 144*a*. Gaps 145 and 145*a*, typically 1/16" to 3/8" occur between flanges 142*b* and 144*b* and the tops of upright legs of the panels. In this embodiment, the clip assembly 140 is made of 20 gauge carbon or stainless steel, where each upright body portion is two inches or more in length. The gap 130 is approximately 1/16 to 3/8 inch. It should be recognized by those of ordinary skill in the art, however, that the sizes and dimensions discussed herein are only indicative of one embodiment of the present invention and that other sizes and dimensions may equally be used with the present invention.

FIG. 2 is a sectional view of the clip assembly 140 of the present invention, here shown used with a typical standing seam roof or skylight assembly. In this assembly, it is seen that the clip assembly 140 is designed to constrain standing seam panels 170 and 180 in conjunction with snap-on joining batten 190 against upward or (limited) sideways movement, but not against movement longitudinal with the panels. In this embodiment the batten 190 is provided with a fin 192 positioned as shown in a gap 130 between upright body portions 142*a*, 144*a*, (see FIG. 1) of clip assembly 140. The clip assembly 140 is secured to a substrate 200 via fasteners 210 that pass through the holes 146 in the lower horizontal flanges 142*c* and 144*c*. As demonstrated in FIG. 2, the gap 130 provides a guide for fin 192 of the batten 190. In this manner, the fin 192 can pass between the upper horizontal flanges 142*b* and 144*b*. If gap 130 is sufficiently wide and/or if the optional fin is not present, the gap 130 allows for slight side-to-side movement of upright body portions 142*a* and 144*a* when subjected to transverse forces. This movement allows the clip assemblies to accommodate slight transverse panel movement. It is to be understood battens without fins may also be used effectively in the practice of the instant invention.

Figure 3:
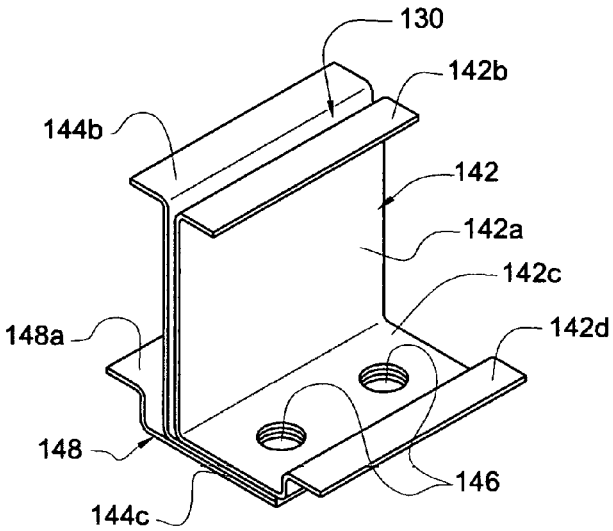
FIG. 3 is an isometric view of another alternative embodiment of the clip assembly of FIG. 2.
Figure 4:
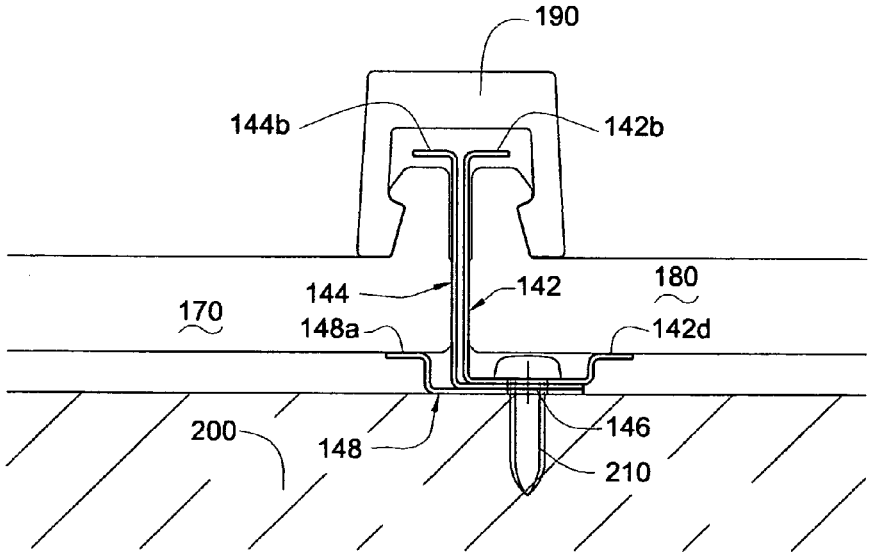
FIG. 4 is a sectional view of the clip assembly of FIG. 3 adapted for use with a standing seam roof or skylight assembly.

FIG. 3 is an isometric view of another embodiment of the clip assembly and should be studied with the sectional view of FIG. 4. In the clip assembly of FIG. 3, the lower horizontal flange 142*c* includes a shoulder or shelf 142*d*, which is formed by a stepped portion. The shelf 142*d* may be formed by extending and bending the horizontal flange 142*c* of FIG. 1 and bending a portion of the lower horizontal flange 142*c*, as shown in FIG. 3 to form the shelf 142*d*. In this embodiment, a base member 148 is also provided with a stepped portion 148*a*. In this configuration, the base member 148 extends beneath the lower horizontal flanges 142*c* and 144*c*, with the stepped portion 148*a* extending in a same direction as the upper horizontal flange 144*b*. The base member 148 also includes holes 146 aligning with the holes of the lower horizontal flanges 142*c* and 144*c*. The stepped portion 148*a* of the base member 148 is substantially the same height as the stepped portion 142*d* of the first clip member 142.

FIG. 4 shows a sectional view of the clip assembly of FIG. 3 used with a standing seam roof or skylight assembly. In the assembled configuration, the stepped portions 148*a* and 142*d* provide a resting place for the panels 170 and 180 to prevent the panels from rubbing on the heads of fasteners during longitudinal thermal expansion of the panels and to raise and support panels 170 and 180 at least 1/4 inch above the substrate 200, thus eliminating contact between the panels and the substrate.

Figure 5:
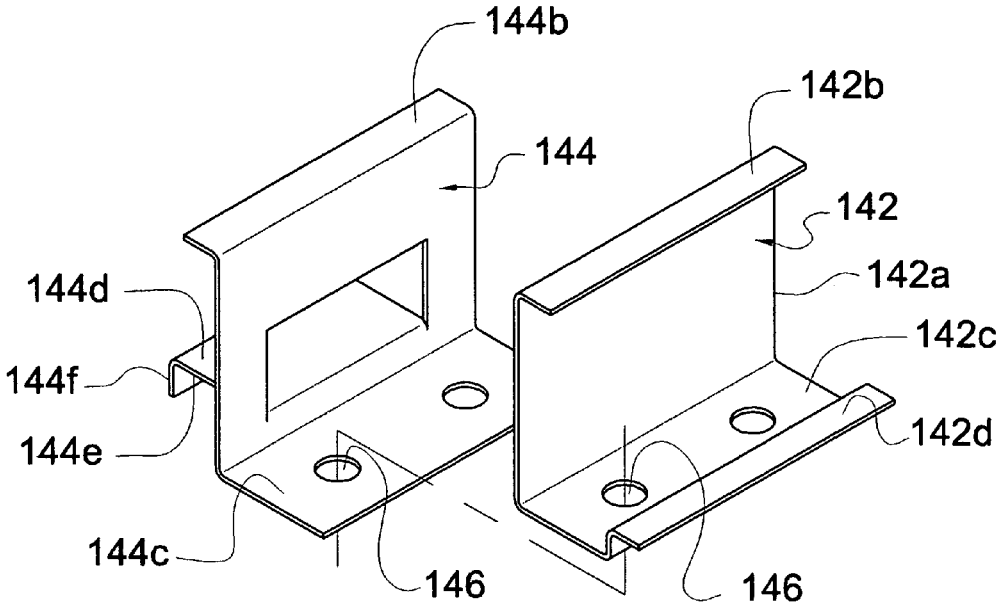
FIG. 5 is an exploded view of another embodiment of the clip assembly.
Figure 6:
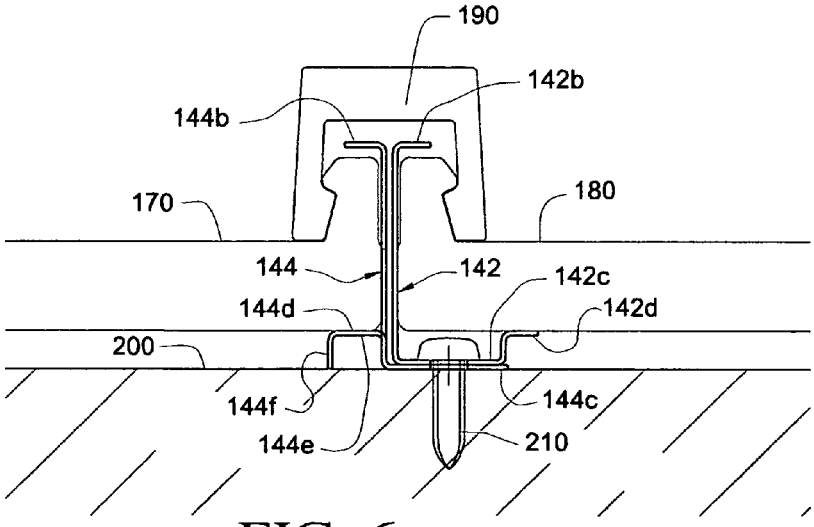
FIG. 6 is a sectional view of the clip assembly of FIG. 5 adapted for use with a standing seam roof or skylight assembly.

FIGS. 5 and 6 should be studied together. FIG. 6 is a sectional view of another embodiment of the clip assembly of the present invention and FIG. 5 is an exploded view of the clip assembly of FIG. 6. In this embodiment, as best seen in FIG. 5, the clip member 144 includes a "punched" out portion 144*d* that acts as a shelf. The shelf 144*d* includes a vertical leg 144*f*. The horizontal surface 144*d* is substantially of the same height as the stepped portion 142*d* of the clip member 142. In use, the panels 170 or 180, as shown in FIG. 6 will rest on the horizontal surface 144*d* and the vertical leg $144f_{will}$ rest on the substrate 200. It should be understood that the clip assemblies of FIGS. 2-6 are fixed relative to the substrate and cause the roof/skylight panels to slide on the clip assemblies during thermal expansion or contraction.

Figure 7:
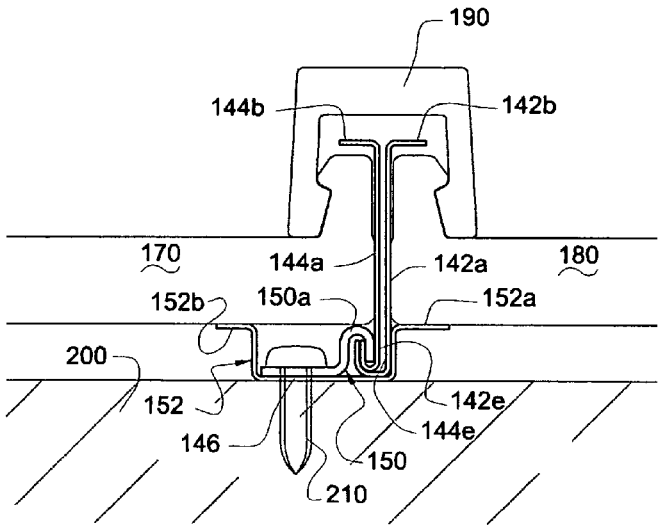
FIG. 7 is a sectional view of yet another embodiment of a clip assembly embodying the invention shown adapted for use in a standing seam roof or skylight assembly.

FIG. 7 is a sectional view of another embodiment of the clip assembly of the present invention, shown adapted for use in a standing roof assembly. In this embodiment, each clip member 142 and 144 includes a bottom curved or substantially "U" shaped member 142*e* and 144*e*, respectively, to form upward facing hooks. The hook 144*e* is nested within the hook 142*e*, and each hook 142*e* and 144*e* is engaged by base member clamp 150. More particularly, the hooks 142*e* and 144*e* are engaged by a downward extending hook 150*a* of the base member clamp 150. The base member clamp 150 further includes a hole(s) or opening(s) 146. Also provided is an additional base member 152 having stepped portions 152*a*, 152*b* extending upward and horizontally. In the assembled configuration, the base member clamp 150 rests on the base member 152 such that the hole(s) of both base member clamps 150 and 152 are aligned, allowing a fastening member 210 to pass therethrough and be secured in substrate 200. The stepped portions 152*a*, 152*b* are substantially equivalent in function to the stepped portions 148*a* and 142*d* of FIG. 4 and the stepped portions 144*d*, 142*d* of FIG. 6. The engagement of the hooked portions 142*e*, 144*e* allows sliding movement between the clip members and the base clamp member 150 secured to the base member 152, where the fastener 210 is in place.

Figure 8:
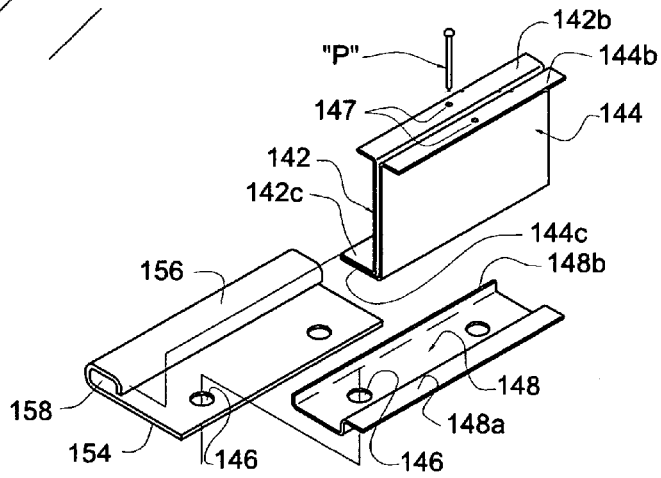
FIG. 8 is an exploded view of another alternative embodiment of the clip assembly of the present invention.
Figure 9:
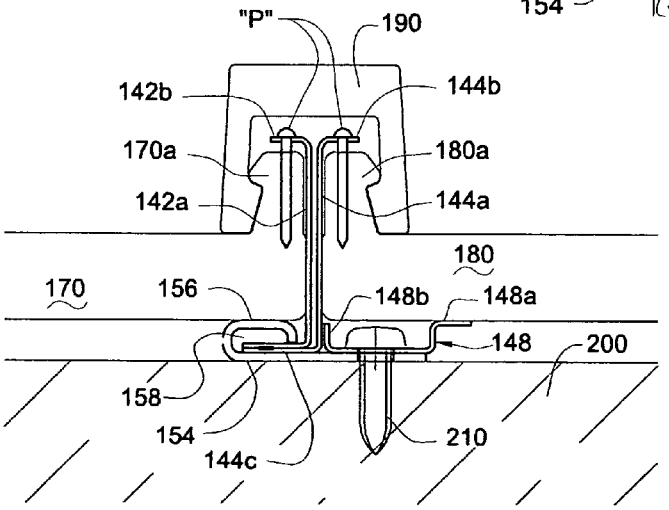
FIG. 9 is a sectional view of the clip assembly of FIG. 8 adapted for use with a standing seam roof or skylight assembly.

FIGS. 8 and 9 should be studied together in conjunction with the description that follows. FIG. 8 is an exploded view of another embodiment of the clip assembly of the present invention. The clip assembly will be referred to as the upper clip assembly in the description that follows. The upper portion of the exploded view includes the features of the embodiment of FIG. 2, except that the lower horizontal flanges 142*c*, 144*c* do not include holes. However, holes 147 are provided on each of the upper horizontal flanges 142*b* and 144*b*. The holes 147 are designed to accommodate pins generally designated as "P". The embodiment of FIG. 8 further includes a base member 148. The base member 148 includes a stepped portion 148*a*, in addition to a vertical leg portion 148*b* on an opposing end of the base member 148. A second base unit 154 is provided which has an upward extending, curved, shelf portion 156 that forms a nearly closed channel 158. The shelf portion 156 is substantially the same height as the stepped portion 148*a*. The second base unit 154 also includes holes 146 that are aligned with the holes 146 of the base member 148.

In an assembled configuration, as shown in FIG. 9, the pins "P" extend through the holes 147 of the upper horizontal flanges 142*b* and 144*b* respectively, and are inserted through upright portions 170*a*, 180*a* of the panels 170 and 180. This allows the upper clip assembly, as noted above, to be securely fastened to the panels, thus allowing the upper clip assembly to move in unison with the panels 170, 180 during expansion or contraction or other longitudinal movement of the panels. The fastening device 210 extends through the holes 146 of the base member 148 and the second base unit 154. This secures the base units 148, 154 to a substrate not shown. The vertical leg 148*b* rests approximate to the upright body portion 142*a*, while the lower horizontal flanges 142*c* and 144*c* are slideably mated within the channel 158, as shown in FIG. 9. This latter feature allows the entire panel assembly and upper clip assembly to slide in a longitudinal direction. The panels 170 and 180 rest on the shelf portions 156 and 148*a*, respectively.

Figure 10:
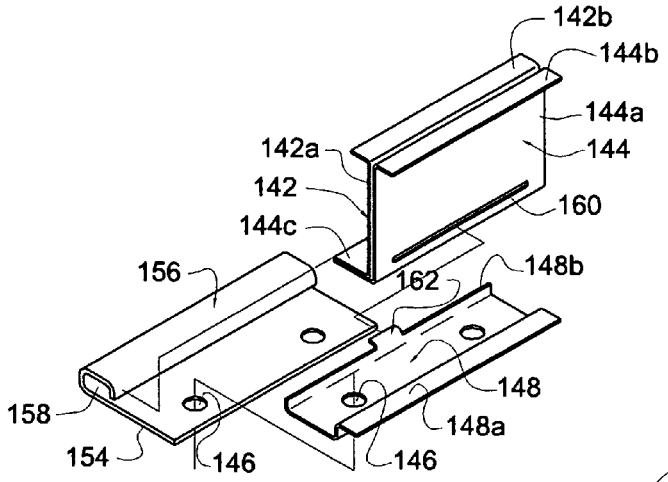
FIG. 10 is an exploded view of another embodiment of the clip assembly.
Figure 11:
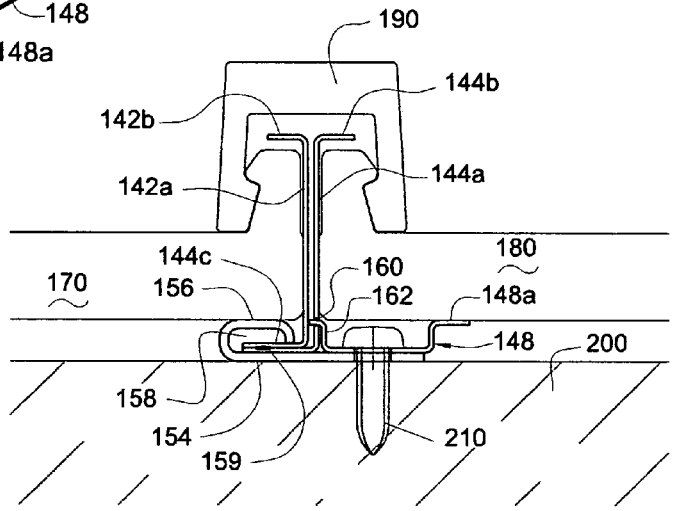
FIG. 11 is a sectional view of another embodiment of the clip assembly of FIG. 10 adapted for use with a standing seam roof or skylight assembly.
Figure 12:
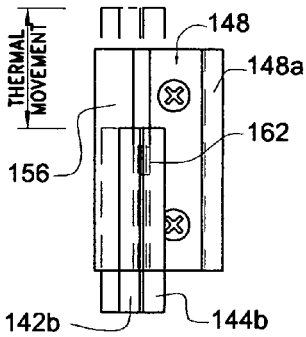
FIG. 12 is a sectional view of the clip assembly, showing the extent of possible travel.
Figure 13:
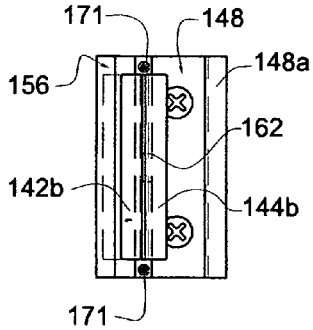
FIG. 13 is a sectional view of the clip assembly in a neutral position.

FIGS. 10 and 11 represent a further embodiment of the clip assembly based on the embodiment of the clip assembly of FIG. 8. In this embodiment, the base member 148 includes a tabbed portion 162 extending from the vertical leg 148*b*. The tabbed portion 162 communicates with a slot 160 positioned within the upright body portion 144*a*. The tabbed portion 162 is centered with respect to both the upright portion 148*b* and the slot 160. The tabbed portion 162 is designed to slide freely within the slot 162 between either end of the slot. For example, as clip members 142, 144 slide in each longitudinal direction, clip member 144 is constrained from further movement whenever one end of the tabbed portion 162 makes contact with an adjoining end of the slot 160. At maximum extension, the end of the slot reaches the tab, thus limiting the extent to which the clip member 144 can slide in either longitudinal direction. This latter feature is illustrated in FIG. 12, whereas FIG. 13 shows the clip assembly in the neutral position. In this embodiment, the base member 148 is approximately 3 inches long, although it is contemplated that the base member can be any length, such as 1½ inch, 6 inches, etc.

Referring to FIG. 13 when installing the slideable clip assembly into a standing seam panel, it is desirable to know that the sliding portion is initially fixed in the center of its range of movement. If so configured, the sliding clip assembly can move in one direction as the panels become colder and in the other direction as the panels become warmer. In order to hold the clip assembly in the central (neutral) position temporarily (until the clip installation is complete), a small dab of sealant 171 may be applied at both ends of base member 148. The sealant will prevent sliding during the assembly process, but will break away and/or disintegrate the first time the clip assembly is caused to move due to thermal expansion of the roof/skylight sheets. By that time, the clip assembly will have been properly located within the roof/skylight panel assembly. The sealant may be a semi-strong material such as plaster, for example.

While the invention has been described in terms of preferred embodiments, those skilled in the art will recognize that the invention can be practiced with modification within the spirit and scope of the appended claims.

It is claimed:

1. A clip assembly for use with a panel system, comprising:

a first clip member having an upright member and an upper flange member and a lower flange member extending therefrom, the first clip member adapted to engage a panel;

a second clip member having an upright member and an upper flange member and a lower flange member extending therefrom, the second clip upright member and upper flange member adapted to cooperate with a panel, the lower flange member of the second clip member extending in a substantially same direction as the lower flange member of the first clip member;

a gap formed between the upright member of the first clip member and the upright member of the second clip member, said gap extending in a manner such that the upright member of the first clip member and the upright member of the second clip member are spaced apart from one another and do not contact one another, wherein the first clip member and the second clip member constrain adjoining panels of the panel system against forces; and, wherein the lower flange member of the first clip member includes at least one hole; the lower flange member of the second clip member includes at least one hole aligned with at least one hole of the lower flange member of the first clip member; and the lower flange member of the second clip member is positioned beneath the lower flange member of the first clip member.

2. The clip assembly of claim 1, wherein the upper flange member of the first clip member and the upper flange member of the second clip member are free of contact with panels except when upward forces on the panels cause contact.

3. The clip assembly of claim 2, wherein a gap is present between the upper flange members and the panels, thereby rendering the upper flange members free of contact with the panels.

4. The clip assembly of claim 1, wherein the first clip member and the second clip member allow for movement of the adjoining panels in the longitudinal direction due to thermal expansion and contraction of the panels.

5. The clip assembly of claim 4, wherein the lower flange member of the first clip member includes a stepped portion.

6. The clip assembly of claim 5, wherein the stepped portion is a raised portion which elevates an adjoining panel of the panel system.

7. The clip assembly of claim 5, further comprising a base member positioned beneath the lower flange member of the second clip member, the base member having at least one hole which is in alignment with at least one hole of the lower flange member of the first clip member and the lower flange member of the second clip member.

8. The clip assembly of claim 7, wherein the base member includes a stepped portion on an opposing end with respect to at least one hole of the base member; the stepped portion of the lower flange of the first clip member and the stepped portion of the base member are substantially a same height.

9. The clip assembly of claim 7, wherein the second clip member includes a punched portion in the upright member, the punched portion having a horizontal surface and a downward extending, vertical leg.

10. The clip assembly of claim 9, wherein: the lower flange member of the first clip member includes a stepped portion; and the horizontal surface of the punched portion is substantially a same height as the stepped portion of the lower flange member of the first clip member.

11. The clip assembly of claim 1, wherein the first clip member and the second clip member allow for movement of the adjoining panels in a transverse direction.

12. The clip assembly of claim 1, further comprising: a first base member having a downward extending hook portion; a second base member positioned beneath the first base member, the second base member having stepped or raised portions at opposing ends, where the lower flange member of the first clip member and the lower flange member of the second clip member are hooked portions nested within one another; and the downward extending hook portion of the first base member slideably engages at least the hooked portion of the first clip member.

13. The clip assembly of claim 12, wherein the first base member and the second base member have at least one aligning hole and the stepped portions are positioned on opposing sides of the first and second clip member.

14. The clip assembly of claim 1, further comprising: a base member having a stepped portion at one end and an upstanding leg on an opposing end; and a sliding member having a stepped portion at a first end which is substantially a same height as the stepped portion of the base member, the sliding member further having a channel associated with the stepped portion, the lower flange member of the first clip member and the second clip member slideably engage the channel such that the first clip member and the second clip member slide with respect to the base member in response to at least longitudinal movement of the adjoining panels of the panel system.

15. The clip assembly of claim 14, further comprising at least one hole formed in each of the upper flange members of the first clip member and the second clip member, the holes are adapted to receive pins which then pass into the panels that engage and cooperate with the first and second clips to thereby secure the first and second clips to the panels.

16. The clip assembly of claim 15, further comprising at least one hole formed in the main base member and the adjoining member, the at least one hole in the main base member aligning with the at least one hole in the adjoining base member.

17. The clip assembly of claim 14, further comprising a blockage material which holds the first clip member and the second clip member in a neutral position and disintegrates or breaks away once the first clip member and the second clip member are subjected to forces sufficient to cause sliding thereof.

18. The clip assembly of claim 14, further comprising: a slot formed in the upright member of the second clip member; and a tabbed portion extending from the base member and slideably engaging with the slot formed in the upright member of the second clip member.

19. The clip assembly of claim 18, wherein movement of the first clip member and the second clip member is limited by the tabbed portion contacting ends of the slot formed in the upright member of the second clip member.

20. A clip assembly for use with a panel system, comprising:

a first clip member having an upright member and an upper flange member and a lower flange member extending therefrom, the first clip member adapted to engage a panel;

a second clip member having an upright member and an upper flange member and a lower flange member extending therefrom, the second clip upright member and upper flange member adapted to cooperate with a panel, the lower flange member of the second clip member extending in a substantially same direction as the lower flange member of the first clip member; and a gap formed between the upright member of the first clip member and the upright member of the second clip member, wherein the first clip member and the second clip member constrain adjoining panels of the panel system against forces, wherein the first clip member and the second clip member allow for movement of the adjoining panels in the longitudinal direction due to thermal expansion and contraction of the panels, and wherein the lower flange member of the first clip member includes a stepped portion.

21. The clip assembly of claim 20, wherein the stepped portion is a raised portion which elevates an adjoining panel of the panel system.

22. The clip assembly of claim 20, further comprising a base member positioned beneath the lower flange member of the second clip member, the base member having at least one hole which is in alignment with at least one hole of the lower flange member of the first clip member and the lower flange member of the second clip member.

23. The clip assembly of claim 22, wherein the base member includes a stepped portion on an opposing end with respect to at least one hole of the base member; the stepped portion of the lower flange of the first clip member and the stepped portion of the base member are substantially a same height.

* * * * *